United States Patent [19]

Birx

[11] Patent Number: 4,514,718

[45] Date of Patent: Apr. 30, 1985

[54] THERMAL CUTOFF CONSTRUCTION, MEMBER THEREFOR AND METHODS OF MAKING THE SAME

[75] Inventor: Linda B. Birx, Beavercreek, Ohio

[73] Assignee: Emerson Electric Co., St. Louis, Mo.

[21] Appl. No.: 557,238

[22] Filed: Dec. 2, 1983

[51] Int. Cl.[3] ..... H01H 37/36

[52] U.S. Cl. ..... 337/407; 337/409

[58] Field of Search ..... 337/407, 408, 409

[56] References Cited

U.S. PATENT DOCUMENTS 4,075,595 2/1978 Plasko ..... 337/407

*Primary Examiner*—Harold Broome

*Attorney, Agent, or Firm*—Candor, Candor & Tassone

[57] ABSTRACT

A thermal cutoff construction, member therefor and methods of making the same are provided, the thermal cutoff construction having an electrical switching unit that changes its operating condition when the member therein melts by being heated to a certain temperature for the particular material that forms the member being utilized. The material of the member comprises 4-methylumbelliferone.

10 Claims, 7 Drawing Figures

THERMAL CUTOFF CONSTRUCTION, MEMBER THEREFOR AND METHODS OF MAKING THE SAME

BACKGROUND OF THE INVENTION

1. Field of the Invention

This invention relates to a new member for a thermal cutoff construction and method of making the same as well as to a thermal cutoff construction utilizing such a member and a method of making the same.

2. Prior Art Statement

It is known to provide a member for a thermal cutoff construction having an electrical switching unit that changes its operating condition when the member therein melts by being heated to a certain temperature for the particular material that forms the member being utilized. For example, see the U.S. Pat. No. 4,075,595, to Plasko.

It is known to form such member of various materials whereby the particular material being utilized for a particular thermal cutoff construction will have a certain melting temperature, such material sometimes including a binder therein, such as an epoxy, and/or sometimes including a lubricant therein, such as calcium stearate, and/or sometimes including a pigment therein, such as a metal oxide for color coding purposes.

It is known to applicant to utilize 4-methylumbelliferone as a brightener for laundry detergent but it is applicant's belief that such material has never been utilized for being the actuator of a thermally responsive device, let alone be utilized for the thermally actuating member of a thermal cutoff construction as set forth above.

SUMMARY OF THE INVENTION

It is a feature of this invention to provide a member for a thermal cutoff construction wherein the member therein is adapted to melt at a certain temperature and thereby cause an electrical switching unit of the thermal cutoff construction to change its operating condition.

In particular, it was found according to the teachings of this invention that such a member can comprise 4-methylumbelliferone whereby the same will substantially always melt at approximately 190° C.

For example, one embodiment of this invention provides a member for a thermal cutoff construction having an electrical switching unit that changes its operating condition when the member therein melts by being heated to a certain temperature for the particular material that forms the member being utilized, the material of the member comprising 4-methylumbelliferone.

Accordingly, it is an object of this invention to provide a new member for a thermal cutoff construction, the member of this invention having one or more of the novel features of this invention as set forth above or hereinafter shown or described.

Another object of this invention is to provide a method of making such a member, the method of this invention having one or more of the novel features of this invention as set forth above or hereinafter shown or described.

Another object of this invention is to provide a thermal cutoff construction utilizing such a member, the thermal cutoff construction of this invention having one or more of the novel features of this invention as set forth above or hereinafter shown or described.

Another object of this invention is to provide a method of making such a thermal cutoff construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
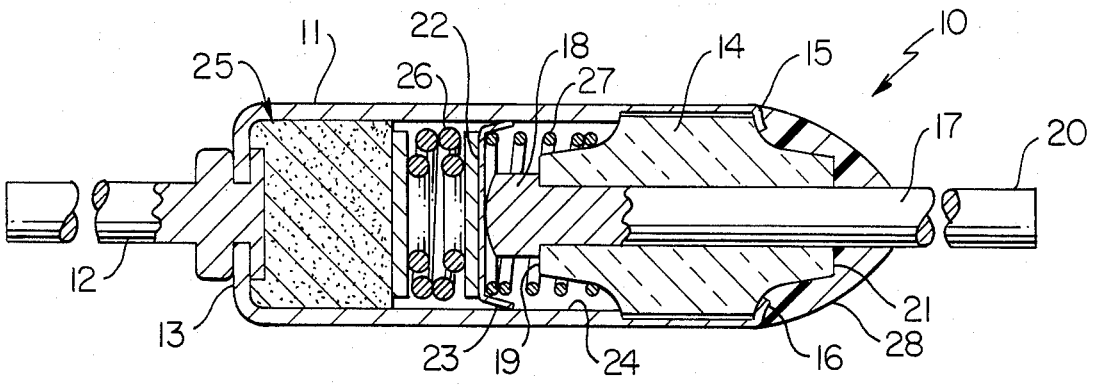
FIG. 1 is an enlarged cross-sectional view of a thermal cutoff construction utilzing the member of this invention.

While the various features of this invention are hereinafter described and illustrated as being particularly adapted to provide a pellet-like member for a particular thermal cutoff construction, it is to be understood that the various features of this invention can be utilized singly or in any combination thereof to provide such a member of different configurations and/or for other types of thermal cutoff constructions as desired.

Therefore, this invention is not to be limited to only the embodiment illustrated in the drawings, because the drawings are merely utilized to illustrate one of the wide variety of uses of this invention.

Figure 2:
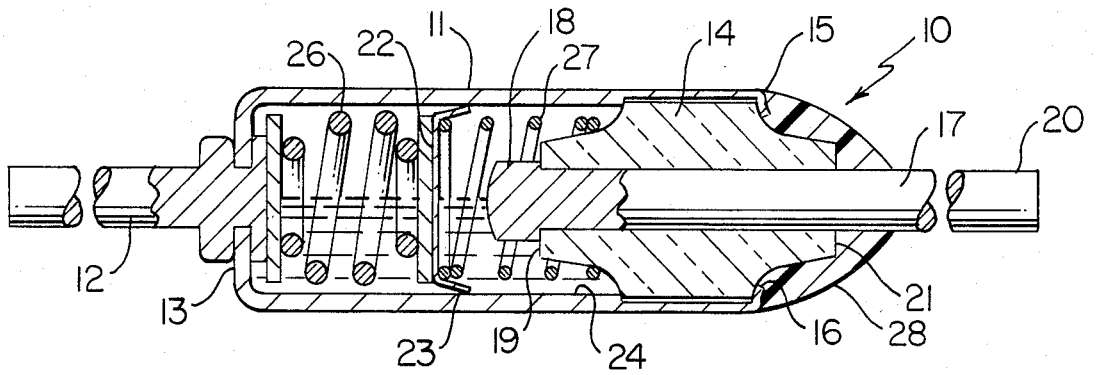
FIG. 2 is a view similar to FIG. 1 and illustrates the thermal cutoff construction after the actuating member thereof has melted to cause the electrical switching unit thereof to change its operating condition.
Figure 7:
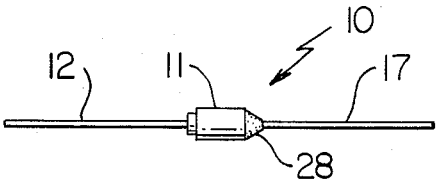
FIG. 7 is an elevation view of the thermal cutoff construction of FIG. 1, but in reduced size, illustrating approximately the actual size of the thermal cutoff construction.

Referring now to FIGS. 1, 2 and 7, the thermal cutoff construction that utilizes the improved features of this invention is generally indicated by the reference numeral 10 and is substantially identical to the thermal limiter construction disclosed in the aforementioned U.S. Pat. No. 4,075,595, to Plasko, as well as disclosed and claimed in the U.S. Pat. No. 3,180,958 to Merrill, and the U.S. Pat. No. 3,519,972, to Merrill, whereby these three U.S. Patents are being incorporated into this disclosure by this reference thereto for any information desired as to the details of the particular parts and operation of the thermal cutoff construction 10.

Therefore, it is believed only necessary to describe the thermal cutoff construction 10 in a general manner in order to fully understand the features of this invention.

Figure 6:
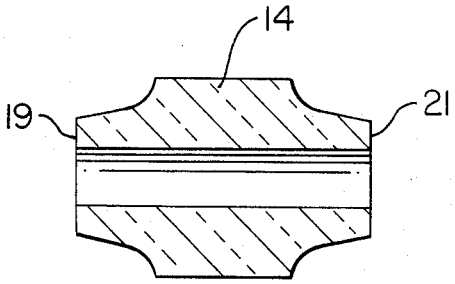
FIG. 6 is a cross-sectional view of the ceramic end plug of the switch construction of FIG. 1.

In particular, the thermal cutoff construction 10 includes a conductive metallic casing 11 having a metallic electrical conductor 12 secured in electrical contact with a closed end 13 of the casing 11. A ceramic end plug 14, as best illustrated in FIG. 6, is disposed in an open end 15 of the casing 11 and is secured thereto by a turned over portion 16 of the end 15 of the casing 11 as illustrated in FIG. 1 while being sealed thereto by an epoxy seal 28, a second metallic electrical conductor 17 passing through the bushing 14 and having an enlarged head 18 disposed against one end 19 of the end plug 14 and another end 20 projecting out of the outer end 21 of the end plug 14 and seal 28 for external lead attachment purposes.

Figure 4:
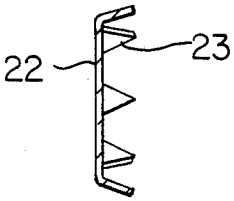
FIG. 4 is a side view of a sliding contact member of the switch construction of FIG. 1.

A sliding conductive contact member 22 of metallic material, as best illustrated in FIG. 4, is disposed inside the casing 11 and has resilient peripheral fingers 23 disposed in sliding engagement with the internal peripheral surface 24 of the casing 11 to provide electrical contact therebetween.

Figure 3:
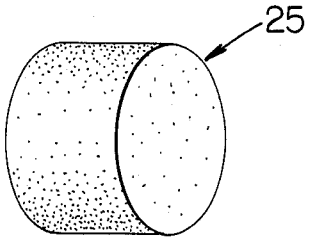
FIG. 3 is a side perspective view illustrating the improved actuating member of this invention.

A thermally responsive pellet-like member 25, as best illustrated in FIG. 3, is formed of material in a manner hereinafter set forth and is disposed in the casing 11 against the end wall 13 thereof.

A pair of compression springs 26 and 27 are respectively disposed on opposite sides of the sliding contact member 22 such that the compression spring 26 is in a compressed condition between the solid member 25 and the contact member 22 and has a stronger compressed force than the force of the compressed spring 27 which is disposed between the contact member 22 and the end plug 14 whereby the contact member 22 is held by the force of the spring 26 in electrical contact with the enlarged end 18 of the conductor 17 so that an electrical circuit is provided between the conductors 12 and 17 through the casing 11 and sliding contact member 22 of the thermal cutoff construction 10 as illustrated in FIG. 1.

Figure 5:
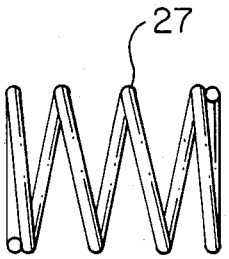
FIG. 5 is a side view of one of the springs of the switch construction of FIG. 1.

However, when the particular temperature for melting the pellet-like member 25 is reached, such as during an adverse heating condition adjacent the thermal cutoff construction 10, the member 25 melts in the manner illustrated in FIG. 2 whereby the springs 26 and 27 are adapted to expand, as illustrated by spring 27 in FIG. 5, and thereby through the relationship of the particular forces and length of the springs 26 and 27, the sliding contact member 22 is moved out of electrical contact with the end 18 of the second conductor 17 in the manner illustrated in FIG. 2 so that the electrical circuit between the conductors 12 and 17 through the thermal cutoff construction 10 is broken and remains open as illustrated in FIG. 2 until the blown thermal cutoff construction 10 is replaced.

As previously stated it is known to form the pellet-like member 25 of various materials whereby the particular material being utilized for the pellet-like member 25 will have a certain melting temperature to change the operating condition of the thermal cutoff construction 10 to the condition illustrated in FIG. 2, such material for the pellet-like member 25 sometimes including a binder therein, such as an epoxy, and/or sometimes including a lubricant therein, such as calcium stearate, and/or sometimes including a pigment therein, such as a metal oxide for the purpose of color coding the pellet-like member 25.

It was found according to the teachings of this invention that the material for forming such a pellet-like member 25 can comprise 4-methylumbelliferone and can be purchased in powder form from various chemical companies, such as from Kodak Laboratory And Specialty Chemicals, Eastman Kodak Co., Rochester, New York, such 4-methylumbelliferone having a C.A.S. Registry No. of 90-33-5 with a melting point of approximately 190° C. at approximately 100% purity.

The powdered 4-methylumbelliferone can be formed into the desired pellet shape or other desired shapes by pressure in a conventional manner for forming the pellet-like members 25 for thermal cutoff constructions and can comprise approximately 100% of such member 25 or can have additional means mixed therewith and before being pressure formed, such additional means being a suitable binder, such as an epoxy, and/or a suitable lubricant, such as calcium stearate, and/or a suitable pigment, such as a metal oxide with the resulting member 25 having at least 25% of the volume thereof formed of 4-methylumbelliferone.

While the particular pellet-like member 25 for the thermal cutoff construction 10 is formed in the shape illustrated in FIG. 3 and is normally designated as a "pellet" in the thermal cutoff art, it is to be understood that the material for such pellet-like member 25 can be formed in other shapes and still provide its actuating function upon melting thereof at its rated melting temperature of approximately 190° C.

Therefore, it can be seen that this invention not only provides an actuating member for a thermal cutoff construction and method of making the same, but also this invention provides a thermal cutoff construction utilizing such an actuating member and a method of making such a thermal cutoff construction.

While the forms and methods of this invention now preferred have been illustrated and described as required by the Patent Statute, it is to be understood that other forms and method steps can be utilized and still fall within the scope of the appended claims.

What is claimed is:

1. In a member for a thermal cutoff construction having an electrical switching unit that changes its operating condition when said member therein melts by being heated to a certain temperature for the particular material that forms the member being utilized, the improvement wherein said material of said member comprises 4-methylumbelliferone.

2. A member for a thermal cutoff construction as set forth in claim 1 wherein said 4-methylumbelliferone comprises approximately 100% of said material of said member.

3. A member for a thermal cutoff construction as set forth in claim 1 wherein said material of said member has additional means therein with said 4-methylumbelliferone providing at least 25% of the volume of said material of said member.

4. A member for a thermal cutoff construction as set forth in claim 3 wherein said additional means of said material of said member comprises a binder.

5. A member for a thermal cutoff construction as set forth in claim 4 wherein said binder comprises an epoxy.

6. A member for a thermal cutoff construction as set forth in claim 3 wherein said additional means of said material of said member comprises a lubricant.

7. A member for a thermal cutoff construction as set forth in claim 6 wherein said lubricant comprises calcium stearate.

8. A member for a thermal cutoff construction as set forth in claim 3 wherein said additional means of said material of said member comprises a pigment.

9. A member for a thermal cutoff construction as set forth in claim 8 wherein said pigment comprises a metal oxide.

10. In a thermal cutoff construction having an electrical switching unit that changes its operating condition when a member therein melts by being heated to a certain temperature for the particular material that forms the member being utilized, the improvement wherein said material of said member comprises 4-methylumbelliferone.

* * * * *